United States Patent [19]

Scherrer

[11] Patent Number: 4,880,448

[45] Date of Patent: Nov. 14, 1989

[54] DOUBLE FILTER INSERT FOR AN AIR CLEANING APPARATUS

[75] Inventor: Fernand Scherrer, Isone, Switzerland

[73] Assignee: Periso SA Elektro-Industrie, Isone, Switzerland

[21] Appl. No.: 326,046

[22] Filed: Mar. 20, 1989

[30] Foreign Application Priority Data

Oct. 25, 1988 [CH] Switzerland ..... 3960/88

[51] Int. Cl.[4] ..... B03C 3/30

[52] U.S. Cl. ..... 55/103; 55/155; 55/274; 55/486

[58] Field of Search ..... 55/103, 155, 274, 486, 55/487

[56] References Cited

U.S. PATENT DOCUMENTS 4,702,940 10/1987 Nakayama et al. ..... 55/487

FOREIGN PATENT DOCUMENTS 217430 12/1984 Japan ..... 55/274

900450 7/1962 United Kingdom ..... 55/487

*Primary Examiner*—Bernard Nozick

*Attorney, Agent, or Firm*—Spencer & Frank

[57] ABSTRACT

A double filter insert for an air cleaning apparatus having an ionizer, consisting of a sheet-like pre-filter of polyester for retaining coarse dust particles and of an also sheet-like electrostatic filter of nonwoven fabric for removing also finest-grain floating particles from the air circulating through the air cleaning apparatus. According to the invention, the double filter insert (1) is characterized by at least one inspection opening (1.3) which, for making visible the degree of contamination of the electrostatic filter (1.2) is provided in the fabric of the overlying pre-filter (1.1), the electrostatic filter (1.2) in the new condition being of a distinctly brighter color than the pre-filter (1.1).

4 Claims, 1 Drawing Sheet

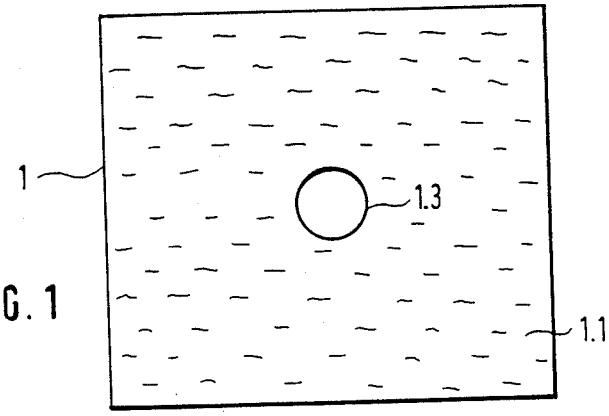
FIG. 1
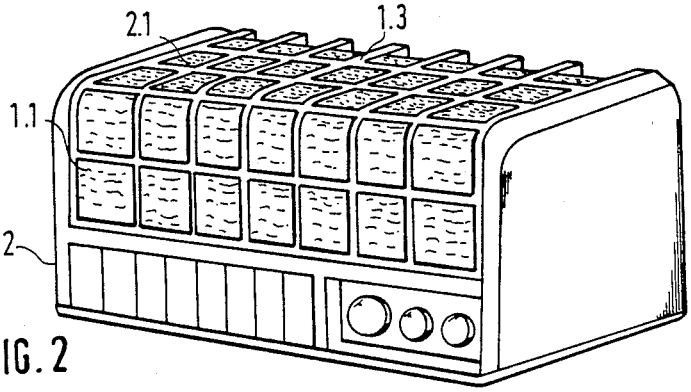
FIG. 2
FIG. 3
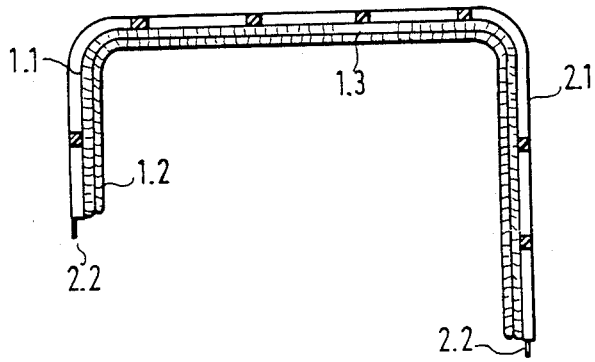

DOUBLE FILTER INSERT FOR AN AIR CLEANING APPARATUS

The invention relates to a double filter insert for an air cleaning apparatus having an ionizer, consisting of a sheet-like pre-filter of polyester for retaining coarse dust particles and of an also sheet-like electrostatic filter of nonwoven fabric for removing also finest-grain floating particles from the air circulating through the air cleaning apparatus.

Double-layer filters comprising a filter fabric of polyester as upper or outer layer facing the inflow of dust-laden or contaminated air, and an electrostatic filter fabric of nonwoven material loosely disposed therebelow or therebehind as lower or inner layer were already employed in a known air cleaning apparatus of the applicant that is equipped with an ionizer. However, the known design is inflicted with the disadvantage that the particular degree of contamination of the electrostatic filter covered by the pre-filter, and thus a possible decrease in its efficacy, cannot be ascertained by visual inspection. For gaining certainty on the condition or operability of the electrostic nonwoven fabric, the double filter insert along with its cover often had to be removed from the air cleaning apparatus to no avail. Apart from the inconvenience caused by the working expenditure required therefor, this fact also meant an undesirable, frequent strain on the plastics mountings of the cover.

It is the object of the invention to ensure a possibility of rapid inspection of the condition of the electrostatic filter without removal of the filter insert along with the cover from the air cleaning apparatus.

The above object is achieved by the provision of an aircleaning apparatus having an ionizer, consisting of a pre-filter of polyester, in sheet form, for retaining coarse dust particles and of an electrostatic filter of nonwoven fabric, also in sheet form, for removing also finest-grain dust particles from the air circulating through the air cleaning apparatus. According to the present invention, the filter insert has at least one inspection opening which, for making visible the degree of contamination of the electrostatic filter, is provided in the fabric of the overlying pre-filter, the electrostatic filter in the new condition being of a distinctly brighter color than the prefilter.

Such a construction of the double filter insert at all times renders possible a rapid inspection of its operating ability, without the insert having to be removed.

Features of an especially advantageous development of the invention involve making the two superimposed filters in the shape of a rectangle having the same area, with the pre-filter covering the electrostatic filter. The two filters may be welded together along their longitudinal edges. According to another feature of the invention, the inspection opening is disposed in the center of the area of the pre-filter. According to another feature, the inspection opening is of circular configuration and has a diameter of 50 mm.

The invention will be elucidated in more detail on the basis of an embodiment shown as an example in the drawings in which FIG. 1 shows a top plan view of the double filter insert according to the invention;

FIG. 2 shows a perspective view of an air cleaning apparatus equipped with a double filter insert according to FIG. 1; and FIG. 3 shows a cross-sectional view through the longitudinal center of the covering grid of the air cleaning apparatus according to FIG. 2 having a double filter insert inserted thereinto.

Of the double filter insert 1 according to the invention as depicted in FIG. 1, only a pre-filter 1.1 forming the upper layer of said insert is visible, said pre-filter 1.1 being provided in the center of its area with a circular inspection opening 1.3 for making visible the degree of contamination of an electrostatic filter 1.2 disposed therebelow. The fabric of the pre-filter 1.1 consists of polyester of a dark color, whereas the electrostatic filter 1.2 arranged as the lower layer and visible through the inspection opening is made of a white nonwoven fabric material. As long as a high contrast in colors is present between the two filters 1.1, 1.2, the electrostatic filter 1.2 remains effective.

The inspection opening 1.3 also could be disposed at a different location of the pre-filter 1.1, and it could also have a different configuration. Moreover, the use of several inspection openings would be feasible as well.

The diameter of the circular inspection opening 1.3 expediently can be chosen to be 50 mm as in the embodiment shown in FIG. 1.

The two superimposed filters 1.1, 1.2 are of rectangular configuration and have the same surface area, so that the upper pre-filter 1.1 exactly covers the electrostatic filter 1.2. The filters are welded to each other along their lateral edges.

The practical application of the double filter insert 1 according to the invention in an air cleaning apparatus 2 having an ionizer can be gathered from FIG. 2. As can be seen especially from FIG. 3, the double filter insert 1 is placed against the inside surface of a covering grid 2.1 of plastics material belonging to the air cleaning apparatus 2 such that the pre-filter 1.1 is directed outwardly. In doing so, the inspection opening 1.3 of the latter comes to lie approximately below the rear half of the covering area of the covering grid 2.1.

FIG. 3 indicates furthermore mounting means 2.2 which also consist of plastics material and are located at the lower edge of the two lateral surfaces of the covering grid 2.1.

The principles, preferred embodiments and modes of operation of the present invention have been described in the foregoing specification. The invention which is intended to be protected herein, however, is not to be construed as being limited to the particular forms disclosed, since these are to be regarded as illustrative rather than restrictive. Variations and changes may be made by those skilled in the art without departing from the spirit of the invention.

I claim:

1. A double filter insert for an air cleaning apparatus having an ionizer, consisting of a pre-filter of polyester in sheet form for retaining coarse dust particles and of a electrostatic filter of nonwoven fabric, also in sheet form, for removing also finest-grain dust particles from the air circulating through the air cleaning apparatus, the filter insert having at least one inspection opening which, for making visible the degree of contamination of the electrostatic filter, is provided in the fabric of the overlying pre-filter, the electrostatic filter in the new condition being of a distinctly brighter color than the pre-filter.

2. A double filter insert according to claim 1, characterized in that wherein the two superimposed filters each have the shape of a rectangle having the same area, the pre-filter exactly covering the electrostatic filter and the two filters being welded together along their longitudinal edges.

3. A double filter insert according to claim 2, the inspection opening is disposed in the center of the area of the pre-filter.

4. A double filter insert according to claim 3, wherein the inspection opening is of circular configuration and has a diameter of 50 mm.

* * * * *